United States Patent [19]

Grebik

[11] 4,136,922

[45] Jan. 30, 1979

[54] IGNITION CABLE TERMINALS

[75] Inventor: Stephen J. Grebik, Roseville, Mich.

[73] Assignee: Essex International, Inc., Fort Wayne, Ind.

[21] Appl. No.: 824,903

[22] Filed: Aug. 15, 1977

Related U.S. Application Data

[63] Continuation of Ser. No. 598,363, Jul. 23, 1975, abandoned.

[51] Int. Cl.[2] ..... H01R 11/08

[52] U.S. Cl. ..... 339/223 S; 339/276 T

[58] Field of Search ..... 339/223 R, 223 S, 97 C, 339/276 R, 276 T; 174/84 C, 94 R; 29/630 A

[56] References Cited

U.S. PATENT DOCUMENTS

| | | | |
|---|---|---|---|
| 1,706,005 | 3/1929 | Thompson | 339/223 R |
| 2,288,918 | 7/1942 | Parker | 339/223 S |
| 2,535,013 | 12/1950 | Freedom | 339/276 T |
| 2,789,278 | 8/1957 | Soreng | 339/258 S |
| 3,112,150 | 11/1963 | Hammell | 339/276 T |
| 3,278,889 | 10/1966 | Elliott | 339/223 S |
| 3,383,457 | 5/1968 | Schumacher et al. | 339/276 R |
| 3,404,368 | 10/1968 | Roberts et al. | 339/223 S |
| 3,683,309 | 8/1972 | Hirose | 338/66 |
| 3,740,702 | 6/1973 | Moray | 339/223 S |

OTHER PUBLICATIONS

IBM Bulletin, Cioffi et al., Wire Barrel Connector, vol. 8, No. 10, Mar.-1966, p. 1328.

*Primary Examiner*—Neil Abrams

*Attorney, Agent, or Firm*—Learman & McCulloch

[57] ABSTRACT

This disclosure relates to ignition cable terminals and their methods of manufacture, and to the application of such terminals to conventional cables of the kind having a non-metallic core projecting from one end of an insulating jacket, the core being provided with conductive material having radio frequency suppression characteristics. A terminal is formed from a blank of conductive metal and has flanges at one end to form a cylinder that may be clamped to the insulating jacket and the opposite end of the blank has flanges which are rolled to form a socket for the reception of a spark plug electrode. Between the ends of the terminal is an intermediate body portion which is offset toward the longitudinal axis of the terminal to provide a base on which the core may seat. The offset base is flanked by a pair of arms which are deformed to provide curved surfaces confronting the core and overhanging the base, the arms being bent toward and into engagement with the core to clamp the latter between the base and the arms.

10 Claims, 14 Drawing Figures

IGNITION CABLE TERMINALS

This is a continuation of application Ser. No. 598,363, filed in the U.S. Patent Office on July 23, 1975 now abandoned.

This invention relates to terminals of the kind especially adapted for use with an ignition cable having a core projecting beyond one end of an insulating jacket. Terminals constructed according to the invention are especially adapted for use with an ignition cable having a core formed of nonmetallic material, but which is provided with conductive material on its surface.

Ignition cables of the kind with which terminals constructed according to the invention are especially adapted for use conventionally comprise a non-metallic core strong in tension provided on its surface with material having radio frequency suppression characteristics. The core is located at the center of an insulating jacket which conventionally is composed of an intermediate sheath of a braided textile or glass fiber material and over which is an outer sheath of relatively soft silicone or other rubbery material.

The fitting of terminals to cables of the kind described has been accomplished largely by stripping the insulating jacket from one end of the cable so as to expose a length of the core. The core is then doubled back along the adjacent end of the jacket and one end of a tubular, metallic terminal is fitted over both the jacket and the doubled back core. The tubular end of the terminal then is crimped or radially compressed tightly about the jacket and the doubled back core so as to effect physical engagement between the terminal and the conductive material on the core. The crimped end of the terminal conventionally is provided with inwardly directed barbs or teeth which pierce the rubbery jacket and imbed themselves in the woven braid so as to provide greater pull-off strength between the terminal and the cable than is possible to obtain simply by imbedding the barbs in the rubbery jacket alone.

When a terminal is attached to a cable in the described manner, the double back core becomes imbedded in the relatively soft, rubbery insulating sheath, but immediately following the crimping operation the conductive material on the core nevertheless engages the terminal inasmuch as the inherent resiliency of the rubbery material constantly exerts a radially outward force on the core to urge it toward the terminal portion which encircles the jacket. When the cable is fitted to an automotive engine, however, the combined effects of time and temperature changes to which the terminal and cable are subjected causes the rubbery material in which the core is embeded to take a permanent set. That is, the rubbery material loses its resilience and no longer urges the doubled back core radially outwardly into engagement with the terminal. It thus is possible for a small clearance to exist between the terminal and the conductive material on the core.

A small clearance between the conductive material on the core and the terminal normally does not prevent the cable from functioning when the engine to which it is fitted is operating. This is because the voltage carried by the core during engine operation is sufficiently great to establish an arc which spans such clearance. However, the presence of such clearance is disadvantageous for other reasons. For example, when an ignition cable having such a clearance between its core and its terminal is tested by electronic ignition analyzing mechanisms, the existence of the clearance often indicates that the cable is inoperative, thereby resulting in its replacement. Further, the presence of arcs between the core and the terminal adversely affects the conductive material on the core, particularly in those instances in which the conductive material comprises carbon particles with which the non-metallic core is coated or impregnated.

Another disadvantage of the doubled back cable and terminal assembly is that the pull-off strength of the terminal is almost totally dependent upon the reaction between the terminal barbs and the braid. Since the number and radial length of the barbs necessarily must be limited, the pull-off strength is considerably less than that which could be achieved if the core could be utilized to assist in the retention of the terminal on the cable.

A further disadvantage of the doubled back cable and terminal assembly is that a considerable length of the core must project from the jacket to provide a sufficient core length to be doubled back. Thus, the cable initially must be manufactured to a length greater than that of the finished cable. Since the insulating jacket must be stripped from the core prior to the doubling back of the latter, this construction not only results in waste of significant amounts of jacketing material, but also necessitates the use of considerably greater lengths of core material.

The disadvantages of the doubled back cable and terminal assembly have been recognized heretofore and many proposals have been suggested for minimizing the disadvantages. Some of these proposals are illustrated in U.S. Pat. Nos. 3,015,684 and 3,404,368. These patents disclose embodiments wherein arms forming part of a terminal are bent or rolled to engage the core and press the latter tightly against a portion of the insulating jacket which otherwise encircles the core. These constructions are subject to the same disadvantages referred to above in connection with the presence of a clearance existing between the core and the terminal due to the material of the jacket taking a permanent set.

In any construction in which a portion of a terminal is shaped in such manner as to engage forcibly some portion of the core, and if the core is a member on which is wound a conductive wire, considerable care must be taken to avoid cutting of the wire at the points where it is engaged by the terminal. If the wire is cut, it becomes non-conductive from the point of the cut to the free end of the core. In the case in which the conductive wire is cut, there may be no electrical continuity at all between the core and the terminal or, if there is continuity, the current density can be excessive.

An object of this invention is to provide an ignition cable and terminal assembly which overcomes or greatly minimizes the disadvantages referred to above.

Another object of the invention is to provide a terminal for an ignition cable and which assures excellent conductivity between the terminal and the core throughout the life of the assembly.

A further object of the invention is to provide a terminal of the character described and which may be assembled on an ignition cable in such manner that the core of the cable assists in retaining the terminal on the cable.

Other objects and advantages of the invention will be pointed out specifically or will become apparent from the following description when it is considered in conjunction with the appended claims and the accompanying drawings, in which:

Figure 9:
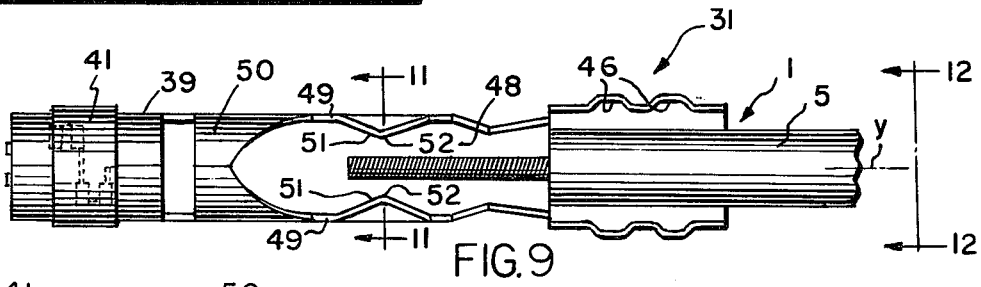
FIG. 9 is a top view illustrating the partially formed terminal in condition to be applied to a cable.
Figure 10:
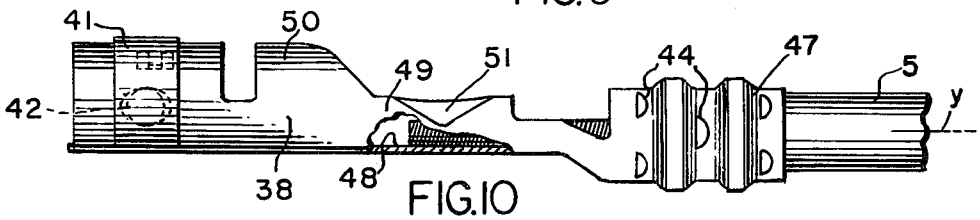
FIG. 10 is a side view of the assembly of FIG. 9, but illustrating the terminal fully applied to a cable.
Figure 13:
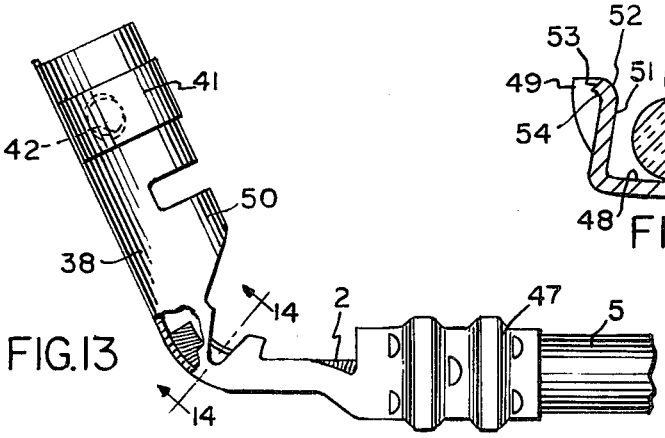
Figure 11:
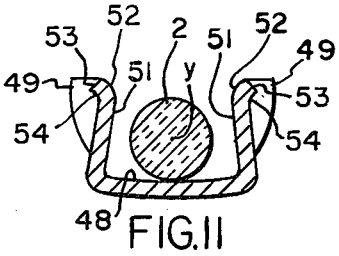
Figure 12:
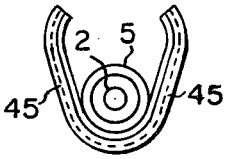
Figure 14:
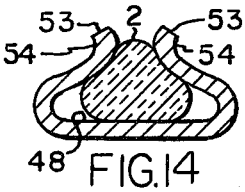

FIGS. 11 and 12 are sectional views taken on the lines 11—11 and 12—12, respectively, of FIG. 9;

FIG. 13 is a side view illustrating the terminal of FIG. 10 bent between its ends; and FIG. 14 is a sectional view taken on the line 14—14 of FIG. 13.

Figure 2:
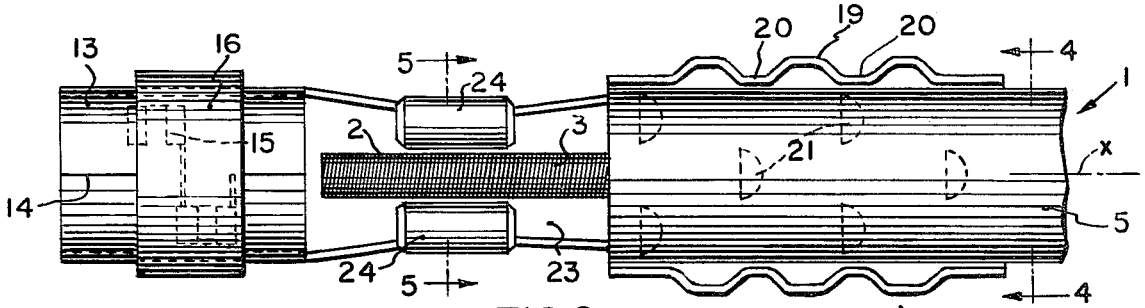
FIG. 2 is a top plan view illustrating a partially formed terminal in condition to be applied to an ignition cable.
Figure 3:
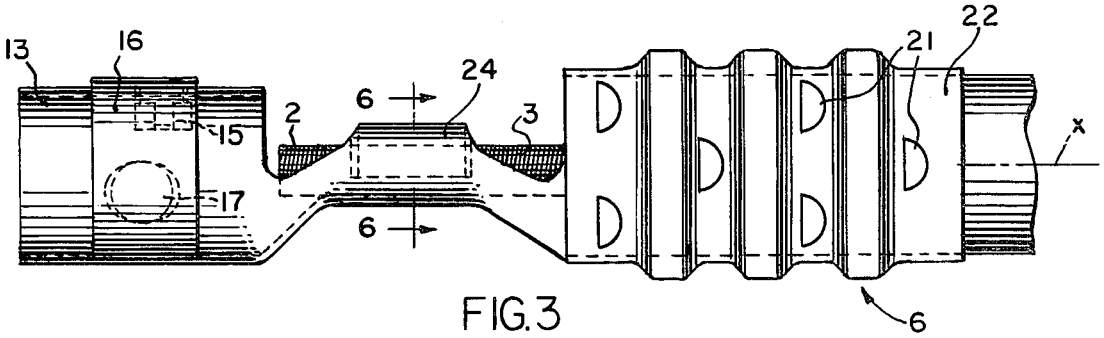
FIG. 3 is a side elevational view of the assembly shown in FIG. 2, but illustrating the terminal fully assembled with the cable.
Figure 4:
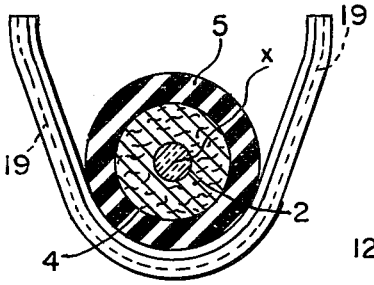
FIG. 4 is a sectional view taken on the line 4—4 of FIG. 2.

A terminal constructed according to any of the disclosed embodiments of the invention is especially adapted for use with an ignition cable 1 having a core 2 formed of non-metallic material having an extremely high degree of tensile strength. The core may be formed of a suitable material such as solid glass fiber strands, or a plurality of glass fiber rovings, or a glass fiber rope, or any other material having the requisite tensile strength. The core should be capable of suppressing radio frequency radiations and, if it is to be of the inductive impedance type, the core may be wound spirally around its surface with a metallic, conductive fine wire 3 as is shown in FIGS. 2 and 3. Alternatively, if the core is to be of the resistance type, it may have its surface coated or impregnated with conductive particles such as carbon or the like (not shown). The core preferably is encased within a sheath 4 formed of braided textile or glass fibers, and the sheath 4 is encased within an insulating jacket 5 formed of silicone or other rubbery material. The sheath and the jacket are stripped from one end of the core in a conventional manner, so that a desired length of the core projects beyond the jacket.

A terminal constructed according to the embodiment illustrated in FIGS. 1-6 is indicated generally by the reference character 6 and is formed from a blank 7 of conductive metal which is cut from a metal strip 8 by conventional progressive dies (not shown). The blank terminates at one end in a flange 9 and at the other end in a flange 10. Between the flanges 9 and 10 is an intermediate body portion 11 having laterally extending tabs 12.

In the formation of the terminal 6 from the blank 7, the flange 10 is rolled to form a cylindrical socket 13 adapted to accommodate a spark plug electrode (not shown). The confronting ends of the flange meet to form a split seam 14 and may be provided with interlocking fingers 15 which underlie a generally C-shaped spring clip 16 having projection 17 adjacent the ends thereof which extend through correspondingly spaced openings 18 formed in the flange so as to enable the projections to provide yieldable gripping means for the electrode.

The flange 9 at the opposite end of the blank 7 is rolled into a trough-like configuration having upstanding legs 19 and axially spaced grooves 20. Along each groove the flange 9 is upset at circumferentially spaced intervals to provide barbs or teeth 21 which extend inwardly of the trough defined by the legs 19. The legs 19 are adapted to be rolled to form a cylindrical anchor sleeve 22 which may be crimped tightly about the jacket 5, thereby causing the barbs 21 to imbed themselves in the jacket and to force those portions of the jacket 5 between adjacent grooves 20 to expand radially.

Preferably, the cylinder 22 has a longitudinal axis X which coincides with the longitudinal axis of the cable 1. The intermediate body portion 11 of the terminal 6 between the tabs 12 preferably remains flat, but is offset by means of a conventional die process, relative to the longitudinal axis of the cylinder 22. The amount of offset preferably is such that the inner surface of the body portion 11 is spaced from the axis X by an amount corresponding substantially to the radius of the core 2, thereby providing a base 23 on which the projecting end of the core 2 may be supported with its longitudinal axis coinciding with that of the jacketed core. The projecting end of the core, therefore, need not be kinked or bent.

The tabs 12 are bent outwardly and upwardly from the base 23, by a conventional die process, to form upstanding arms 24 which are joined at corresponding ends to the base 23, but which are free at their opposite ends 25. The arms 24 are rolled between their ends toward one another and toward the base 23 to provide smoothly curved clamp surfaces 26 which confront one another and overlie the base 23 to form with the latter a triangular clamping zone. The initial spacing between the curved surfaces 26 is such that the bared core 2 may be accommodated on the base and encircled by the latter and the curved arm portions 26 and without engaging the arms. The length of each arm 24 and the radius on which it is rolled preferably are such that the free ends 25 of the arms are spaced from the base 23 a distance less than the radius of the core 2.

Figure 5:
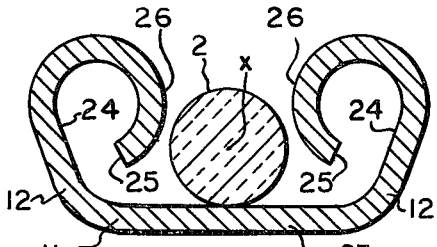
FIG. 5 is a sectional view taken on the line 5—5 of FIG. 2.
Figure 6:
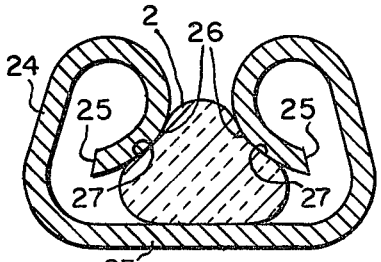
FIG. 6 is a sectional view taken on the line 6—6 of FIG. 3.
Figure 8:
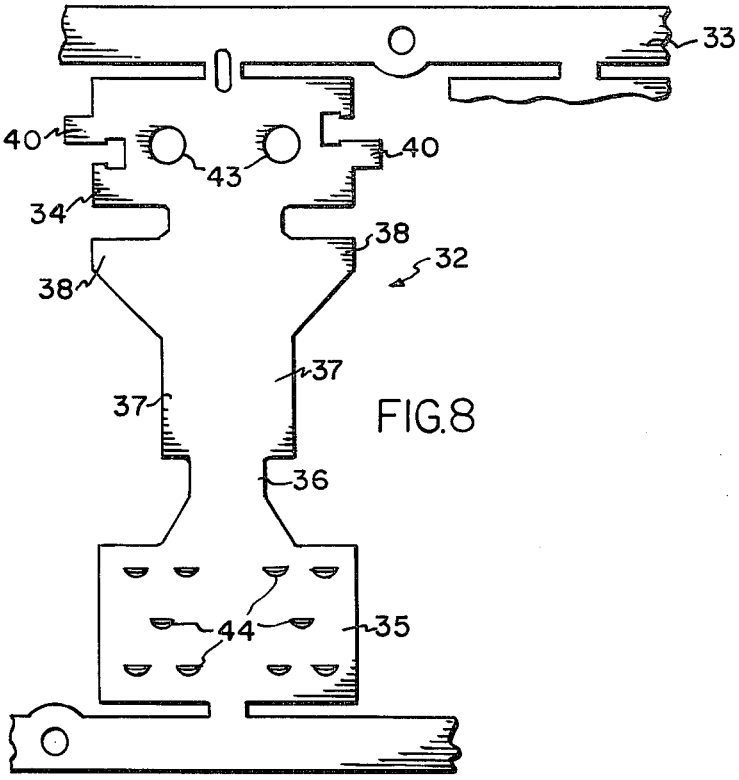
FIG. 8 is a view like FIG. 1, but illustrating a blank for forming a modified embodiment of the terminal.

To complete the assembly of the terminal 6 and the cable 1, the arms 24 are bent toward one another from the position shown in FIG. 5 to the positions shown in FIG. 6. Those curved portions 26 of the arms 24 which confront the core 2 thus will be moved forcibly into engagement with the core, and with the conductor 3 on the core 2, so as to clamp the core tightly and directly between the arms and the base 23. The force with which the arm portions 26 grip the core may be such as to deform the core into a substantially triangular configuration, as is indicated in FIG. 6, thereby providing indentations 27 in the core occupied by the adjacent arm portions 26 and resulting in an extremely strong connection between the terminal and the core.

The purpose of locating the free ends 25 of the arms 24 initially at a distance from the base 23 which is less than the radius of the core 2 is to assure that, during bending of the arms from the positions shown in FIG. 5 to the positions shown in FIG. 6, the free ends 25 do not engage either the core 2 or the conductor 3. The relatively sharp edges of the free ends 25 thus cannot engage and cut the conductor 3. Instead, engagement between the conductor 3 and the arms occurs only along the smoothly rounded surfaces 26.

When a cable and terminal have been assembled in the manner described, the terminal not only is fixed to the cable by means of the barbs 21, but also is fixed to the cable by the reaction between the base 23, the clamping arms 24 and the core 2. The tensile strength of the core thus may be availed of to maintain the terminal and cable assembled.

Figure 1:
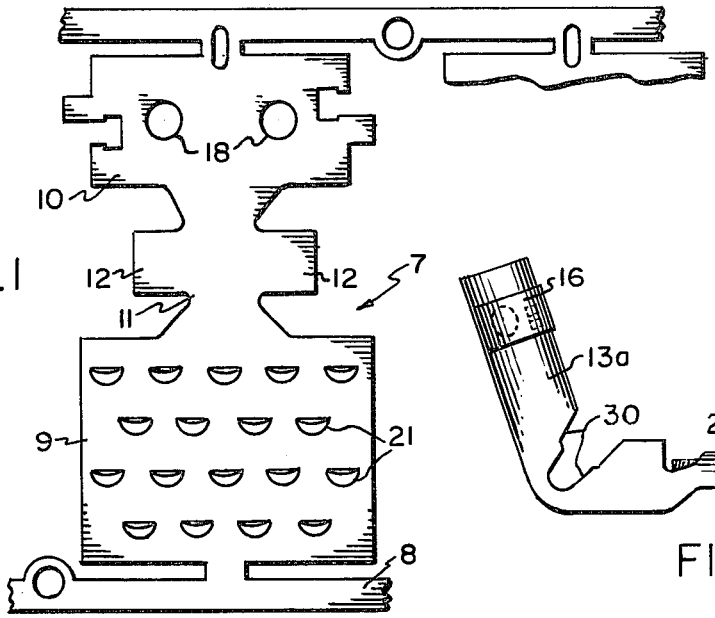
FIG. 1 is a plan view of a blank of metal from which a terminal according to one embodiment of the invention may be formed.
Figure 7:
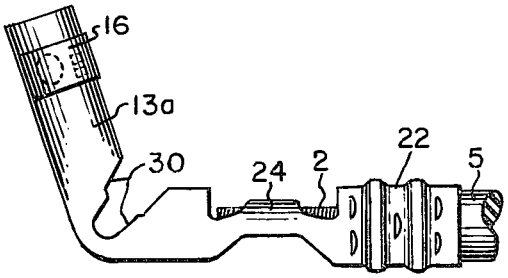
FIG. 7 is a view similar to FIG. 3, but illustrating a modification.

The embodiment of the invention shown in FIG. 7 corresponds substantially to that disclosed in FIGS. 1–6 with the exception that the modified embodiment has a cylindrical socket 13*a* which is longer than the socket 13 and has its walls cut away on opposite sides thereof to provide substantially V-shaped openings 30. The openings 30 make it possible for the socket 13*a* to be bent about an arc so that the socket 13*a* and the anchor cylinder 22 form therebetween an included angle of between 90° and less than 180°. In all other respects, the terminal construction illustrated in FIG. 7 corresponds to that described earlier.

A terminal 31 constructed in accordance with the embodiment disclosed in FIGS. 8–14 is formed from a blank 32 of conductive metal strip 33 by conventional progressive dies (not shown). The blank terminates at one end in a flange 34 and at the opposite end in a flange 35. Between the flanges 34 and 35 is an intermediate body portion 36 having laterally extending arms or flanges 37 and tabs 38.

The flange 34 is rolled to form a cylindrical socket 39 that is adapted to accommodate a spark plug electrode and is provided with interlocking fingers 40 over which is placed a conventional C-shaped spring clip 41 having projections 42 which extend through openings 43 formed in the flange 34.

The flange 35 is upset at spaced intervals to form teeth or barbs 44 and is rolled into a trough-like configuration having upstanding legs 45 and axially spaced grooves 46. The legs 45 may be rolled to form a cylindrical anchor sleeve 47 that is crimped tightly about the jacket 5, thereby causing the barbs 44 to imbed themselves in the jacket and anchor the terminal 31 to the ignition cable 1. The anchor sleeve 47 has a longitudinal axis Y which coincides with the longitudinal axis of the cable 1.

At a point spaced from the anchor sleeve 47 the intermediate body portion 36 is offset upwardly so that its upper surface is spaced from the axis Y by an amount corresponding substantially to the radius of the core 2, thereby providing a base 48 on which the projecting end of the core 2 may be supported with its longitudinal axis coinciding with that of the jacketed core.

The flanges 37 and the tabs 38 associated with the intermediate body portion 36 are rolled upwardly so that the flanges 37 form upstanding, spaced apart arms 49 and the tabs 38 are rolled toward one another to form a sleeve 50 of the same size as the socket 39. The arms 49 are deformed toward one another to provide indentations 51 which overhang the base 48, and together with the latter form a triangular clamping zone. The indentations initially are spaced a sufficient distance apart to permit introduction of the core 2 between them with the core encircled by the indentations and the base. The indentations 51 are essentially V-shaped, but have confronting clamp surfaces 52 that are rounded, rather than sharp. The indented portions of the arms terminate in free ends 53 which are rolled outwardly along a radius to provide smoothly curved surfaces 54. The rolling of the arm portions is accomplished by conventional dies.

Following the securing of the anchor sleeve 31 to the jacket 5 of the cable 1, the indented portions 51 of the arms 49 are deformed toward one another and toward the base 48 so as to move from the positions shown in FIG. 11 to the positions shown in FIG. 14 in which latter positions the core 2 is clamped tightly and directly between the indented portions of the arms and the base 48. The height of the arms 49 is such that the core 2 will be engaged by the rounded portions 54 of the respective arms. The outward curling of the free ends 53 of the arms assures that the sharp edges of the free ends of the arms will not engage either the core or the conductive material thereon. As a consequence, the arms 49 may grip the core with such force as to deform the latter into a substantially triangular configuration to provide an extremely strong connection between the terminal and the core.

In its final form, the terminal may have the configuration shown in FIG. 10 or, if desired, it may be bent between its ends so that the socket 39 and the anchor sleeve 47 form an included angle therebetween. The indented portions 51 of the arms 49 provide a convenient zone at which to effect bending of the terminal by conventional bending dies (not shown). The included angle formed between the opposite ends of the terminal thus may be any desired angle between 90° and less than 180°.

Tests have demonstrated that the pull-off strength of a terminal constructed and assembled in accordance with any of the disclosed embodiments of the invention in as much as 40% greater than the pull-off strength of terminals applied to cables utilizing the doubled back core technique.

Tests performed on cable and terminal assemblies according to the invention have demonstrated the ability of such assemblies to withstand 300 hours of operation at 500° F. with no significant changes in resistance. In contrast, cable and terminal assemblies utilizing the doubled back core technique were unable to withstand identical tests, nor were they able to withstand, without appreciable changes in resistance, similar tests for a period of 48 hours conducted at only 450° F.

This disclosure is representative of presently preferred terminals and their methods of manufacture, but is intended to be illustrative rather than definitive of the invention. The invention is defined in the claims.

What is claimed is:

1. An ignition cable and terminal assembly comprising a substantially cylindrical core having conductive material at least on its outer surface and encircled by an insulating jacket, at least one end of said core projecting wholly beyond said jacket; and an elongate, metal conductive member having at one of its ends first means receiving and gripping said jacket and having at its opposite end second means for connection to an electrical terminal, said member having an intermediate portion between its said ends comprising a smooth surface base on which the projecting end of said core lies, said intermediate portion being flanked by a pair of upstanding arms each of which is fixed at one end to said base and has its other end free, each of said arms being rolled to provide between its ends a smooth clamp surface overhanging said base with the free ends of said arms being spaced apart and extending away from one another and being free from engagement with said core and said member, said clamp surfaces and said base forming a triangular clamping zone comprising three circumferentially spaced contact points encircling said core, each of said arms engaging and clamping said core directly against said base, said core resisting a tendency of that part of each of said arms between its clamp surface and its free end to unroll.

2. The assembly according to claim 1 wherein said member has a longitudinal axis passing through said first means and wherein said base is offset relative to said first means in a direction toward said axis.

3. The construction according to claim 2 wherein the extent of offset of said base is such that it is spaced from said axis a distance corresponding substantially to the radius of said core.

4. The construction according to claim 1 wherein said arms are rolled in a direction toward one another.

5. The construction according to claim 1 wherein said arms are rolled through more than 180° and wherein the free ends of said arms confront their respective arms between the fixed and free ends thereof.

6. The construction according to claim 1 wherein said arms are indented inwardly toward one another.

7. The construction according to claim 6 wherein said member is bent at the indentations so that said first and second means form an included angle therebetween 90° and less than 180°.

8. The assembly according to claim 1 wherein said arms engage said core with such force as to deform said core.

9. The assembly according to claim 1 wherein said conductive material comprises a wire wrapped around said core.

10. The assembly according to claim 1 wherein said conductive material comprises conductive particles carried on the surface of said core.

* * * * *